US005213082A

United States Patent [19]

Abe et al.

[11] Patent Number: 5,213,082

[45] Date of Patent: May 25, 1993

[54] FUEL INJECTION CONTROL SYSTEM FOR INTERNAL COMBUSTION ENGINE

[75] Inventors: Yoshiharu Abe; Naoki Hotta, both of Wako, Japan

[73] Assignee: Honda Giken Kogyo Kabushiki Kaisha, Tokyo, Japan

[21] Appl. No.: 878,599

[22] Filed: May 5, 1992

[30] Foreign Application Priority Data

Jun. 26, 1991 [JP] Japan ..... 3-181777

[51] Int. Cl.[5] ..... F02D 41/06; F02M 31/00

[52] U.S. Cl. ..... 123/491; 123/179.16

[58] Field of Search ..... 123/179.16, 179.21, 123/491, 549

[56] References Cited

U.S. PATENT DOCUMENTS 5,044,331 9/1991 Suga et al. ..... 123/491 X

FOREIGN PATENT DOCUMENTS 127866 9/1981 Japan .

*Primary Examiner*—Tony M. Argenbright

*Attorney, Agent, or Firm*—Nikaido, Marmelstein, Murray & Oram

[57] ABSTRACT

A fuel injection control system for an internal combustion engine equipped with a heater for heating an air-fuel mixture in cold engine start. In the system, the timing to cease injection is first obtained by the coolant temperature and the engine load. The value is then deferred by an amount if the heater is turned on. The amount increases as the heater on-time increases. Then an injection period is added to the timing to cease injection and another timing to commence injection is determined. Thus, the injection timing is deferred if an air-fuel mixture is heated so as to minimize the residence time of the heated fuel. This ensures that the fuel will be quickly drawn to the cylinder to be burnt completely and the composition of the gas is thus improved.

4 Claims, 6 Drawing Sheets

| | | SO | | | Smax |
|---|---|---|---|---|---|
| Pdif (=Pa−Pba) | 2 | 7 | 8 | 10 | 10 |
| | 1 | 7 | 7 | 8 | 8 |
| | 0 | 6 | 7 | 7 | 7 |
| | | 0 | 1 | 2 | |
| | | Tw | | | |

Cy1 PULSE
TDC PULSE
Stage
Cr PULSE
BTDC 100°
BTDC 10°
#4
#2
#1
#3
#4
#2
#1
INJ. NO.
Intake stroke (#4)
Intake stroke (#2)
Intake stroke (#1)
Intake stroke (#3)
Intake stroke (#4)
Intake stroke (#2)
STAGE NO.
STG.FI A
Stages usable for injection (#1)
Stages usable for injection (#4)
STG.FI B
Stages usable for injection (#3)
Stages usable for injection (#2)
FI CAL . TIMING
FI CAL for #1
Intake stroke
Stages usable for injection (#1)

FUEL INJECTION CONTROL SYSTEM FOR INTERNAL COMBUSTION ENGINE

BACKGROUND OF THE INVENTION

1. Field of the Invention

This invention relates to a fuel injection control system for injecting fuel into an air intake passage of an internal combustion engine, and more particularly to such a system including a heater for heating the intake air which improves the composition of the combustion gas at engine cold start.

2. Description of the Prior Art

When a cold engine is started, a part of the fuel injected by the fuel injection valves fails to vaporize because of the low temperature of the intake air and the cylinder walls and this fuel adheres to the walls of the intake passage and the cylinders. The resulting incomplete fuel combustion could produce harmful components that foul the combustion gas. Conventional ways proposed for coping with this problem include that of advancing the fuel injection timing so as to provide a longer period for the injected fuel mist to vaporize and that taught by Japanese Laid-open Utility Model Publication No. 56-127866 of heating the air-fuel mixture.

However, when the injection timing is advanced and, in addition, the air-fuel mixture is heated, a part of the air-fuel mixture vaporized by the heating condenses on the cold intake passage wall while it is resident in the intake passage prior to the cylinder intake stroke. As a result, no substantial improvement in the combustion gas composition is achieved.

It is therefore an object of this invention to provide a fuel injection control system for an internal combustion engine including a heater for heating the intake air which improves the composition of the combustion gas emitted even at the time of cold engine starting.

SUMMARY OF THE INVENTION

This invention achieves this object by providing a system for controlling fuel injection for an internal combustion engine having a heater for heating an air-fuel mixture in an air intake passage of the engine. The system comprises first means for determining, in response to the operating condition of the engine, the timing to cease injection carried out in accordance with an injection period, second means for determining if the heater is turned on, third means for deferring the determined timing to cease injection if the heater is turned on, and control means for ceasing the injection in response to the determined or deferred timing.

BRIEF EXPLANATION OF THE DRAWINGS

These and other objects and advantages of the invention will be more apparent from the following description and drawings, in which.

DETAILED DESCRIPTION OF PREFERRED EMBODIMENT

An embodiment of the invention will now be explained with reference to the drawings.

Figure 1:
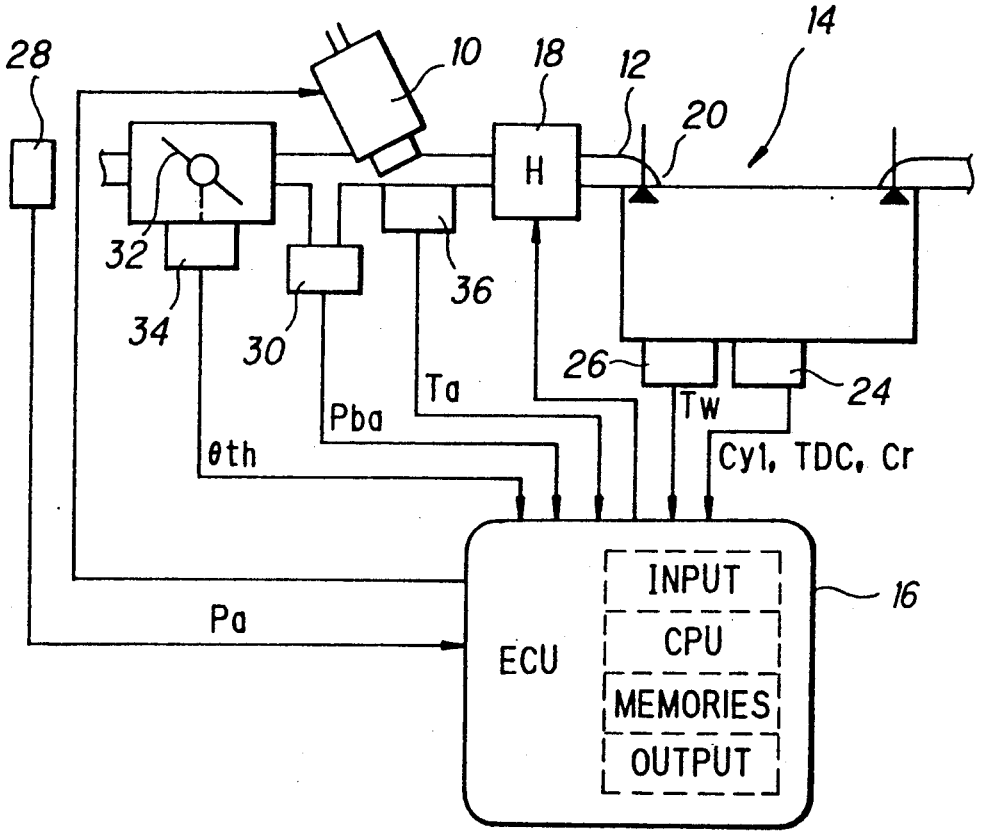
FIG. 1 is an explanatory view showing an overall arrangement of a fuel injection control system for an internal combustion engine according to the invention.

In FIG. 1, reference numeral 10 designates a fuel injector (only one shown) for injecting fuel into an air intake passage 12 of a four-cylinder internal combustion engine 14. Reference numeral 16 indicates an electronic control unit, labeled as "ECU" in the figure, for controlling the fuel injection period of the injector 10, and reference numeral 18 indicates a heater which is turned on for heating the air-fuel mixture when the engine temperature is low. The heater 18 is installed on the air intake passage 12 at a position downstream of the injector 10 and near an intake port 20. The heater 18 is constructed of a PCT (positive characteristic thermistor) heater, namely a heater whose internal resistance rises as its temperature rises with increasing on-time until heat generation substantially stops with the fall of current flow in the vicinity of the Curie point (about 230° C.). The on/off state of the heater 18 is controlled by the control unit 16.

The control unit 16 is made up of a microcomputer as illustrated and in order to determine the injection control value, various sensors are provided to send to the unit signals indicative of the operating condition of engine. More specifically, a crankshaft sensor 24 is provided near a crankshaft, not shown, for detecting a piston position of each cylinder to generate a pulse Cyl once per 720 crank angle degrees, a pulse TDC once per each piston's TDC position, and a unit angle pulse Cr once per 30 crank angle degrees. A coolant temperature sensor 26 is provided near a coolant passage, not shown, for generating a signal Tw indicative of the temperature of the coolant. Two pressure sensors 28, 30 are provided in the air intake passage 12 upstream and down stream of a throttle valve 32 to generate a signal Pa indicative of the atmospheric pressure and a signal Pba indicative of the intake air pressure (manifold pressure) in terms of the absolute pressure. A throttle position sensor 34 is installed in the proximity to the throttle valve 32 to generate a signal 8th indicative of the throttle opening degree and in addition, a second temperature sensor 36 is equipped in the passage 12 downstream of the throttle valve 32 to generate a signal Ta indicative of the intake air temperature.

Figure 2:
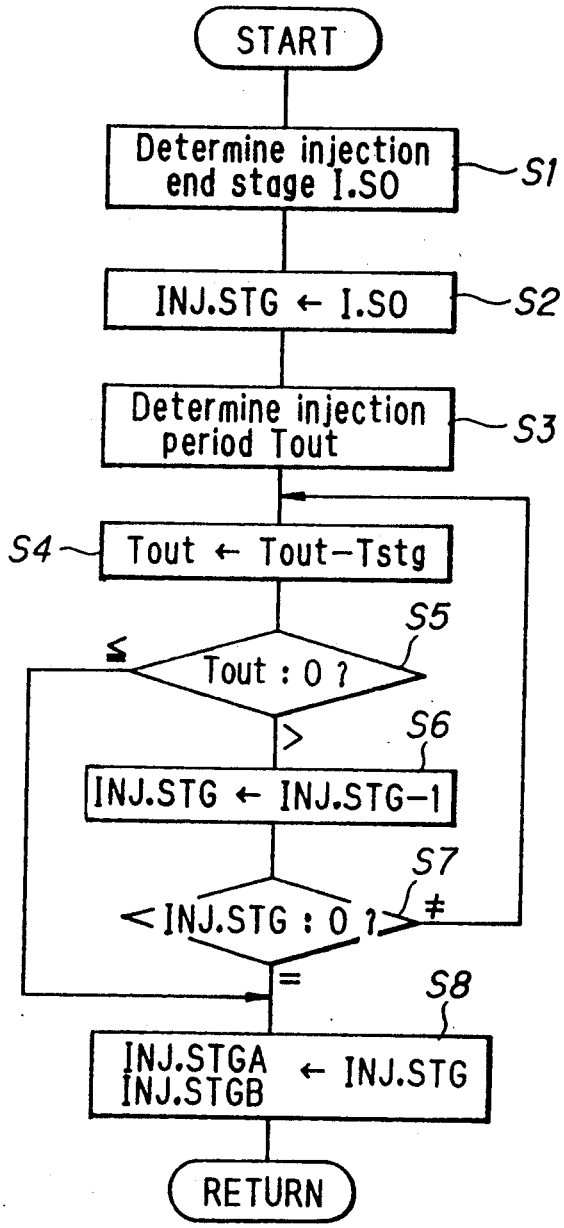
FIG. 2 is a flowchart showing the mode of operation of the system shown in FIG. 1.

The operation of the fuel injection control system will now be explained referring to a flowchart shown in FIG. 2.

Figure 4:
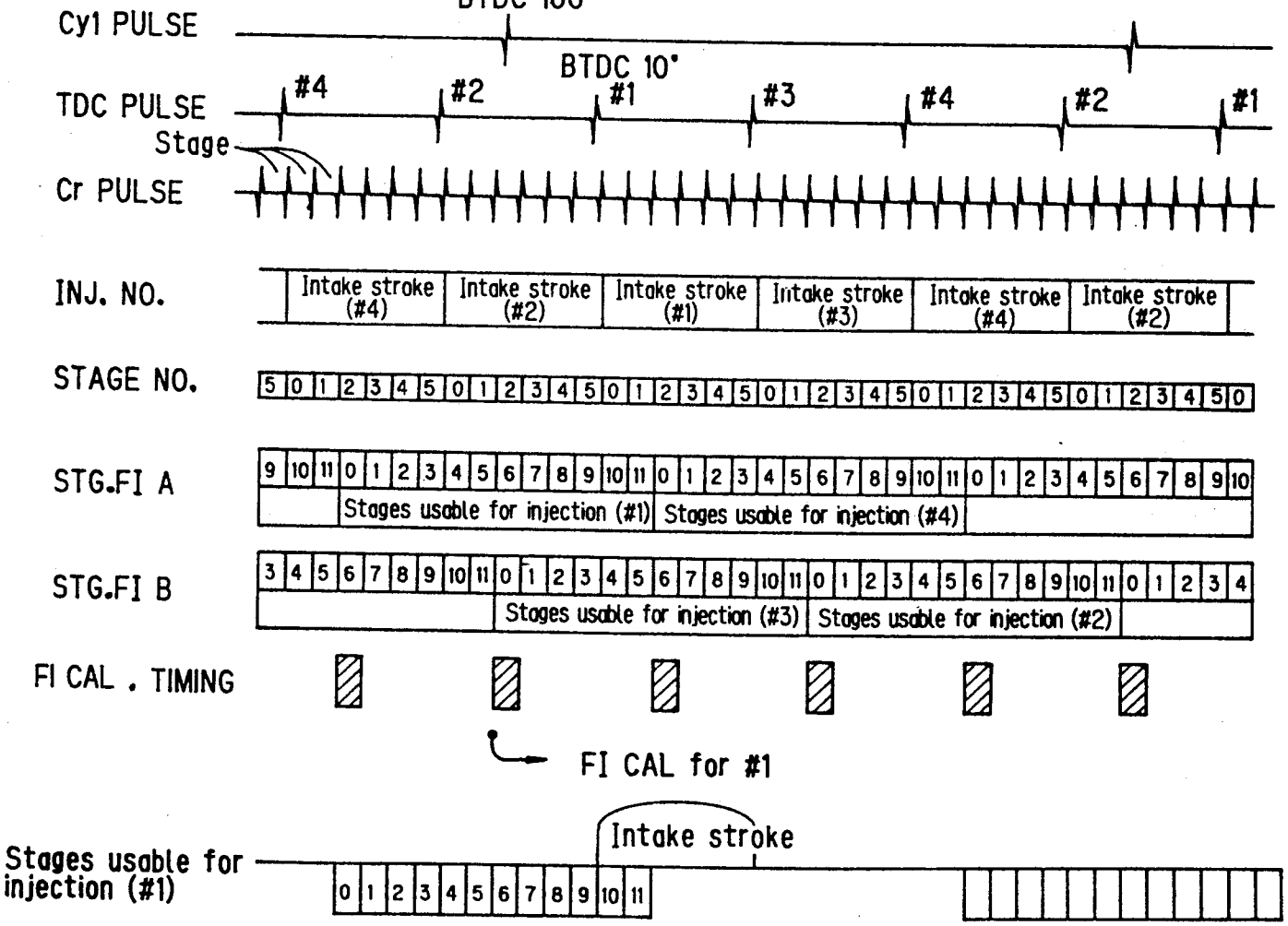
FIG. 4 is a timing chart for explaining the routines illustrated in the flowcharts of FIG. 2 and FIG. 3.

Before entering to the explanation immediately, however, the operation will be briefed here referring to a timing chart shown in FIG. 4. The gist of the operation is to determine the timing to commence injection and for that purpose, a timing to cease injection is firstly determined and based on the timing and an injection period separately determined, the timing to start injection is calculated back inversely. And the characteristic feature of the invention resides in that the injection end timing is deferred (retarded) when the heater is turned on. As illustrated in FIG. 4., the aforesaid Cr pulse is generated once per 30 degrees of crank angles and an interval between the pulses is named as "stage" in this specification. The two timings to commence (start) and to cease (end) injection is therefore defined in terms of the stage. Moreover, the program of the FIG. 2 flowchart is carried in each period shown as "FI CAL TIMING" in FIG. 4. FIG. 4 shows these features focussing on the first, in firing order, cylinder (#1) in the four-cylinder engine 14.

Returning to FIG. 2, the injection end stage I.SO is determined in step S1. This is determined in accordance with a subroutine shown in FIG. 3.

Figure 3:
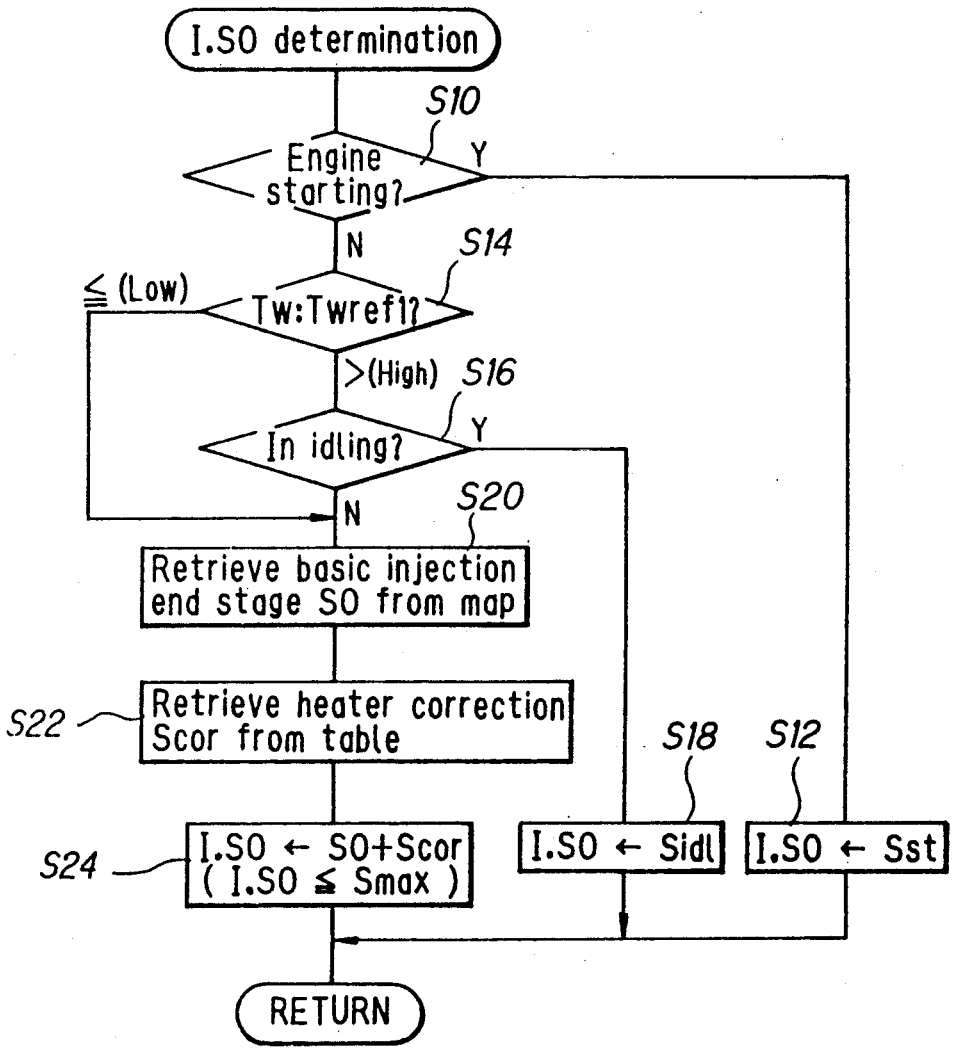
FIG. 3 is a flowchart showing a subroutine for determining an injection end stage used in the routine in the flowchart of FIG. 2.
Figures 5, 6:
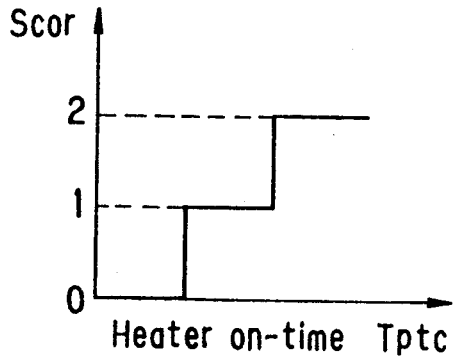
FIG. 5 is an explanatory view showing the characteristics of a map defining a basic injection end stage.
FIG. 6 is an explanatory view showing the characteristics of a table defining a correction value for the basic injection end stage illustrated in FIG. 5.

Namely, in FIG. 3, it is judged in step S10 if the engine is being started. If the judgment is affirmative, the procedure goes to step S12 in which the injection end stage is determined to be a fixed stage Sst. When the judgment in step S10 is negative, in other words if it is found that the engine is already started, the procedure then advances to step S14 in which the coolant temperature Tw is compared with a reference value Twref1 (e.g. 75° C.) and if the temperature is found to be above the value, the procedure then moves to step S16 in which it is confirmed if the engine is idling. If it is found in this step that the engine is idling, the procedure goes to step S18 in which the stage is determined to be another fixed stage Sid1. If the coolant temperature is found to be low or the engine is not idling, the procedure then goes to step S20 in which a basic injection end stage SO is determined by retrieving a map. FIG. 5 shows the characteristics of the map and as shown, the basic injection end stage SO is defined by the coolant temperature Tw with respect to a pressure difference Pdif between the atmospheric pressure Pa and manifold pressure Pba. In step S20, the difference is therefore calculated and using the calculated value and the raw coolant temperature as address data, the basic injection end stage SO is retrieved from the map. In FIG. 5, another map characteristics Smax means the limit value for the injection end stage I.SO. The value Smax is defined for the maximum coolant temperature "2" and is retrieved using the pressure difference only. This will be referred later.

Again returning to FIG. 3, the procedure then advances to step S22 in which a heater correction value Scor is again retrieved from a look-up table. FIG. 6 shows the characteristics of the table. The value Scor is defined to be increased as a heater on-time Tptc during which the heater 18 is being turned on, increases. And since the heater temperature rises as the heater-on time increases, the correction value is defined to become great as the heating temperature rises. The heater correction value Scor is retrieved by the heating time Tptc as address data.

Then, the procedure moves to step S24 in which the injection end stage I.SO is determined by adding the heater correction value Scor, if any, to the basic value SO. This means that the stage to cease injection is deferred as the heating temperature rises when the heater is in operation at a low coolant temperature. If the heater is turned off, the injection is ceased at the stage defined by the basic injection end stage SO. It should be noted in this step that the added value is limited to the aforesaid within a range up to the basic injection end stage at the time that the coolant temperature is highest.

Now returning to FIG. 2, the stage to commence injection is then determined. Namely, the procedure advances to step S2 in which the obtained injection end stage I.SO is temporarily deemed as an initial value for the injection start stage INJ.STAG. More specifically, as shown in FIG. 4, twelve stages 0 to 11 are prepared usable for injection for each cylinder, wherein "0" is the first possible stage and "11" is the last possible stage. If the injection end stage is decided, for example, to be stage 10, the injection start stage is provisionally set to be the same stage.

The procedure then moves to step S3 in which an injection period Tout is determined with respect to time during which the injector 10 is in operation. The period is determined by retrieving a basic period from a map by the engine speed and load and adding necessary corrections thereto. Since the determination is not the gist of the invention, further explanation is omitted.

The procedure then advances to step S4 in which a time Tstg required to rotate over angles corresponding to the aforesaid stage (30 degrees) is calculated and subtracted from the injection period Tout determined. Then, the procedure goes to step S6, via step S5, in which the injection start stage is decremented by one (stage) and then to step S7 in which it is confirmed if the subtracted value reaches to zero. If not, the procedure returns to step S4 and the period is again subtracted by the unit time until it is found in step S5 that the subtracted value has reached to zero or become less than zero. Through the repetition of steps S4 to S7, the injection end stage I.SO is added to stages corresponding to the injection period Tout and the stage INJ.STG to commence injection is thus inversely calculated.

The procedure then moves to step S8 in which the so-obtained injection start stage INJ.STG is set as control values INJ.STGA or INJ.STGB. The control values INJ.STGA and INJ.STGB are alternately produced, one as the injection start stage INJ.STG for a first pair of cylinders (#1,#3) and the other as that INJ.STG for the remaining pair of cylinders (#4,#2) whose crank angle differs 360 degrees from that of the first pair.

Figure 7:
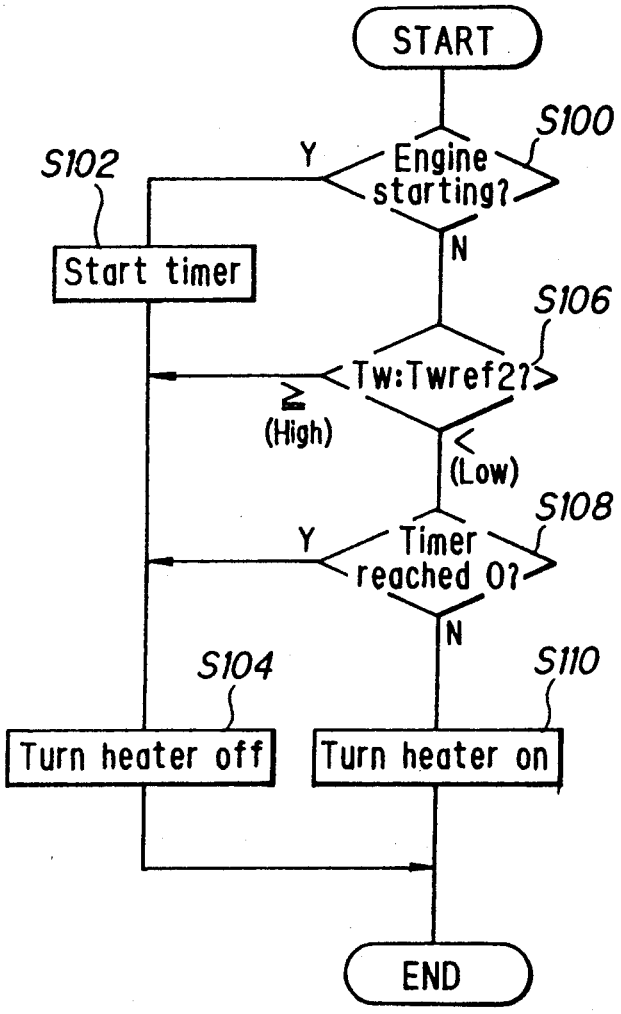
FIG. 7 a flowchart showing heater operation.

FIG. 7 is a flowchart operation for the heater 18 carried out in the control unit 16. As shown, in step S100, it is judged if the engine is being started. If the judgment is affirmative, the procedure goes to step S102 in which a timer (down counter) is set by a value (e.g. 120 sec.) and is started to count down. The procedure then goes to step S104 in which the heater is turned off in order to save battery power consumption. On the other hand, if the judgment in step S100 is negative, namely the engine is already started, the procedure advances to step S106 in which the coolant temperature Tw is compared with a reference value Twref2 (e.g. 80° C). If it is found there that the temperature is lower than the value, the procedure moves to step S108 in which it is judged if the timer value has reached to zero and if not, the procedure goes then to step S110 in which the heater is turned on. Alternatively, if the temperature is found, at step S106, to be greater than the value or if the timer value has been found, at step S108, to reach zero, the procedure advances to step S104 to turn the heater off. The heater 18 is thus turned on if the temperature is below 80° C. within 120 seconds after the engine was started. The on-time of the heater 18 is measured by the unit to retrieve the aforesaid FIG. 6 table.

As explained in the foregoing, the fuel injection control system according to the invention equipped with the heater for heating the injected fuel controls the fuel injection timing in such a manner as to retard the same if the heater is in operation when the engine temperature is low. The system thus ensures that the injected fuel heated by the heater when the engine temperature is low will be quickly drawn into the associated cylinder, thus minimizing the air intake passage residence time of the heated fuel. Since this ensures that vaporized fuel of the prescribed ratio will be burned in the cylinder, it makes it possible to keep the generation of noxious exhaust components within the prescribed limits and to improve the composition of the combustion gas even at the time of cold engine starting.

The present invention has thus been shown and described with reference to the specific embodiments. However, it should be noted that the present invention is in no way limited to the details of the described arrangements but changes and modifications may be made without departing from the scope of the appended claims.

What is claimed is:

1. A system for controlling a fuel injection for an internal combustion engine having a heater for heating an air-fuel mixture in an air intake passage of the engine; comprising:

first means for determining, in response to the operating condition of the engine, the timing to cease injection carried out in accordance with an injection period;

second means for determining if the heater is turned on;

third means for deferring the determined timing to cease injection if the heater is turned on; and control means for ceasing the injection in response to the determined or deferred timing.

2. A system according to claim 1, wherein said third means defers the timing to cease injection by an amount which varies with the heater-on time.

3. A system according to claim 2, wherein the amount increases as the heater on-time increases.

4. A system according to claim 1, wherein said first means determines the timing to cease injection in response to at least one of engine load and engine coolant temperature.

* * * * *